US012070668B1

(12) United States Patent
Vaughn

(10) Patent No.: US 12,070,668 B1
(45) Date of Patent: Aug. 27, 2024

(54) SPORTS EQUIPMENT STRAP DEVICES, SYSTEMS, AND METHODS

(71) Applicant: Ryan Vaughn, San Clemente, CA (US)

(72) Inventor: Ryan Vaughn, San Clemente, CA (US)

( * ) Notice: Subject to any disclaimer, the term of this patent is extended or adjusted under 35 U.S.C. 154(b) by 0 days.

(21) Appl. No.: 18/407,261

(22) Filed: Jan. 8, 2024

Related U.S. Application Data

(60) Provisional application No. 63/517,564, filed on Aug. 3, 2023.

(51) Int. Cl.

| | |
|---|---|
| ***A63B 69/00*** | (2006.01) |
| ***A63B 71/14*** | (2006.01) |
| *A63B 69/38* | (2006.01) |
| *A63B 102/08* | (2015.01) |
| *A63B 102/14* | (2015.01) |
| *A63B 102/18* | (2015.01) |

(52) U.S. Cl.
CPC ..... *A63B 69/0059* (2013.01); *A63B 69/0002* (2013.01); *A63B 71/141* (2013.01); *A63B 71/143* (2013.01); *A63B 2069/0008* (2013.01); *A63B 69/0015* (2013.01); *A63B 69/0017* (2013.01); *A63B 69/0026* (2013.01); *A63B 69/38* (2013.01); *A63B 2102/08* (2015.10); *A63B 2102/14* (2015.10); *A63B 2102/18* (2015.10); *A63B 2209/10* (2013.01); *A63B 2214/00* (2020.08)

(58) Field of Classification Search
CPC ..... A63B 69/0059; A63B 69/0002; A63B 69/0026; A63B 2069/0008; A63B 71/143; A63B 2102/08; A63B 2102/14; A63B 2102/18; A63B 2209/10
USPC ..... 473/458, 422
See application file for complete search history.

(56) References Cited

U.S. PATENT DOCUMENTS

| | | | | |
|---|---|---|---|---|
| 4,691,387 | A * | 9/1987 | Lopez | A63B 71/141 2/160 |
| 4,700,405 | A * | 10/1987 | Sternberg | A63B 71/146 2/161.1 |
| 5,184,815 | A * | 2/1993 | Maddox | A63B 69/0002 473/458 |
| 5,692,242 | A * | 12/1997 | Tekerman | A63B 71/148 473/458 |
| 5,987,646 | A * | 11/1999 | Bolmer | A41D 19/01523 473/458 |
| 6,233,744 | B1 * | 5/2001 | McDuff | A63B 71/143 2/163 |
| 6,279,164 | B1 * | 8/2001 | Martin | A63B 71/143 473/458 |
| 6,415,445 | B1 * | 7/2002 | Nishijima | A63B 71/146 2/161.4 |

(Continued)

*Primary Examiner* — Mitra Aryanpour
(74) *Attorney, Agent, or Firm* — Knobbe, Martens, Olson & Bear, LLP

(57) ABSTRACT

A method of holding a sport equipment can comprise optionally placing a first and/or second hand in a first and/or second hand covering device. A user may position the first hand through a loop of a strap device. The user may place the first hand around a sport equipment. The user may place the second hand around the sport equipment and a grip portion of the strap device at the same time. The user may apply or attempt to apply the sport equipment to an incoming object by swinging the sport equipment in a loop trajectory such that the first hand and the second hand move together through the completion of the trajectory.

10 Claims, 15 Drawing Sheets

(56) References Cited

U.S. PATENT DOCUMENTS

| | | | | |
|---|---|---|---|---|
| 6,721,960 | B1 * | 4/2004 | Levesque | A63B 71/143 2/161.1 |
| 6,732,377 | B1 * | 5/2004 | Wilkinson | A63B 71/146 2/161.4 |
| 9,155,951 | B2 * | 10/2015 | Ahern | A63B 69/0059 |
| 10,850,181 | B2 * | 12/2020 | Restko | A63B 69/0059 |
| 2009/0253538 | A1 * | 10/2009 | True | A63B 71/143 473/458 |

* cited by examiner

SPORTS EQUIPMENT STRAP DEVICES, SYSTEMS, AND METHODS

PRIORITY CLAIM TO RELATED APPLICATIONS

The present application claims priority benefit under 35 U.S.C. § 119(e) to U.S. Provisional Application Ser. No. 63/517,564, filed Aug. 3, 2023, entitled "SPORTS EQUIPMENT STRAP DEVICES, SYSTEMS, AND METHODS," the disclosures of which are incorporated herein in their entirety by reference.

BACKGROUND

Field

This disclosure relates to a device, system, method, and assembly for holding a sport equipment, such as a baseball or softball bat, and maintaining a two-hand contact with the said equipment throughout a strike motion or a swing motion or an attempt to swing motion. Although certain aspects and features of the present disclosure are described herein with respect to baseball or softball, the scope of the present disclosure is not limited to the field of baseball or softball and can include other sports or activities. For example, the present disclosure can be used in tennis, cricket, badminton, pickleball, golf, lacrosse, field hockey, ice hockey, ping pong, or any other sport that requires both hands of a user to remain engaged in a follow-through motion during a swinging motion or an attempt to do so or after contacting another object (such as a ball).

Certain Related Art

Sport equipment and sport accessories include various articles used in or around a particular sport, such as in preparation for a particular sport, during training sessions, during an actual game or during a competitive event. Some sport accessories (for example, baseball bats, tennis rackets, golf clubs) are required for an athlete (or a user in general) to perform a particular sport. Other accessories can help protect the user during the sport and/or help improve the user's performance. For example, helmets can protect an athlete's head, gloves can help protect the hands of a baseball player (and/or assist a baseball player to have a better grip of a baseball bat). But while the gloves can help protect the skin of a baseball player's hands, the baseball player remains vulnerable to the injuries that may arise in follow-through motions that come during a swinging motion or attempting to swing or after the user actually hits a ball.

SUMMARY

The present disclosure recognizes problems with swinging motions currently implemented in sports and solutions that addresses the issues that a user can encounter during a follow-through motion during the user's swing or attempts to make a swing or actually hits a ball with a sport equipment.

One concern relates to the user's performance when hitting or attempting to hit a ball (or other object) with a sport equipment or during and/or after swinging (or attempting to swing) a sport equipment. For example, during a game of baseball, a hitter holding a baseball bat would want to hold the baseball bat with two hands and maintain the two-hand contact with the baseball bat before the user attempts to swing or hit a ball, during the swing motion or after the user actually hits the ball and until after the hitting motion or the strike motion or the swing motion is completed. The swing or strike motion may approximately resemble a semi-circular motion. The ability to maintain both hands on the baseball bat throughout the motion enables the user to maintain a better control and/or increase swing speed which could allow a ball to travel faster and a longer distance. The device disclosed in the present disclosure can address this concern. For example, by simulating a locking motion that encourages the user to use both hands, the device(s) of the present disclosure can create more power on the swing. The device(s) disclosed in the present disclosure can also encourage the user to keep the upper hand closer to the lower hand and/or to the knob of the bat, thereby generating a larger moment which can contribute to a larger power that the user can generate. The device disclosed in the present disclosure can put together the speed of the front hand or bottom hand with the back hand or upper hand, thereby allowing the user to stay together and use the power of their legs on contact with the ball to improve the power that the user can generate.

Another concern relates to the user's health and wellbeing during the follow-through motion. For example, during a game of baseball, when the second hand loses contact with the baseball bat after the user swings or attempts to swing or actually hits a ball, the uncontrolled motion of the first hand/arm/shoulder could result in injury in the first hand/arm/shoulder that remains in contact with the baseball bat. The device disclosed in the present disclosure can address this concern. For example, by forcing the user to keep both hands on the bat after the user swings or attempts to swing, the device of the present disclosure can reduce the amount of force that is exerted on the user's body during a swinging motion.

Another concern relates to the health and wellbeing of the people that are around the user after an uncontrolled follow-through motion. For example, during a game of baseball (or during a training session), after the user attempts to hit a ball or does hit a ball, the uncontrolled (typically one-handed) follow-through motion could injure the catcher, the umpire, or any other person that is near or around the user. The device disclosed in the present disclosure can address this concern. For example, by shortening the back swing and the corresponding follow through motion, it is less likely that the follow through motion can cause injury to the people that are around the hitter.

Another concern relates to the adaptability of devices or methods that assist the user with maintaining a follow-through motion. For example, a device that works with certain sports equipment may not be suitable for many users who prefer different types of sport equipment. For example, a device that adapts with certain batting gloves corresponding with a certain brand may not be suitable for users who prefer a different brand. The device(s) disclosed in the present disclosure can be used with a variety of different brands and different types of equipment.

Another concern relates to the method by which the user can maintain two-hand contact with the sport equipment and which can allow the user to quickly switch between different accessories. For example, during a game of baseball, the user may want to quickly drop a baseball bat. A device that locks two hands together or locks one (or both) hands with the baseball bat may not suitable. The device of the present disclosure can address this concern by allowing the user to quickly drop the baseball bat without locking the user's hands with the baseball bat.

Another concern relates to the durability of a device that assists the user with a follow-through motion or control of that motion. For example, certain sports are performed outdoor, and the device may be subject to adverse weather. The device of the present disclosure can include durable material that can accommodate adverse weather conditions and be used in different weather conditions.

In some aspects, the techniques described herein relate to a method of holding a sport equipment with two hands. The method can include optionally placing a first and second hand in a first and second hand covering device. The method can include positioning the first hand through a loop of a strap device. The method can include placing the first hand around a sport equipment. The method can include placing the second hand around the sport equipment and a first portion of the strap device at the same time. The method can include applying the sport equipment to an incoming object by swinging the sport equipment in a trajectory such that the first hand and the second hand move together through the completion of the trajectory.

In some aspects, the techniques described herein relate to a method, wherein the sport equipment is a baseball bat.

In some aspects, the techniques described herein relate to a method, wherein the first hand includes a first hand covering, and the second hand includes a second hand covering.

In some aspects, the techniques described herein relate to a method, wherein the first and the second hand covering is a pair of gloves.

In some aspects, the techniques described herein relate to a method, wherein the incoming object is a ball.

In some aspects, the techniques described herein relate to a strap device for securing a first hand and a second hand of a baseball player to a baseball bat during a swinging motion. The strap device can include a strip. The strip can include a first layer having a first end and a second end, the first layer including nylon webbing. A second layer can have a first end and a second end. The second layer can include leather and can be configured to contact the baseball bat in use. In some aspects, the strap device can include a Velcro® fastening system. The Velcro® fastening system can include a hook and a loop. The strip can turn such that the first end of the first layer contacts the second end of the first layer. The strip can form a loop portion and a grip portion. The loop portion can be configured to receive the first hand of the baseball player and the grip portion can be configured to receive the second hand of the baseball player. The hook of the Velcro® fastening system can be positioned on the loop portion, and the loop of the Velcro® fastening system can be positioned on the grip portion. The second layer can be sewn to the first layer. In some aspects, the strap device can be configured to allow the baseball player to release the first hand from the loop portion after the baseball player releases the second hand from the grip portion.

In some aspects, the techniques described herein relate to a swinging assist strap for assisting with a swing of sports equipment. The swinging assist strap can include an elongate body having a first side, a second side opposite the first side, a first end, and a second end opposite the first end. The elongate body can include a first layer positioned on the first side, the first layer having a first length. The elongate body can include a second layer positioned on the second side. The second layer can have a second length. A first strip attachment can be positioned on the first side and adjacent to the first end of the elongate body. The elongate body can include a second strip attachment. In some aspects, the second end of the elongate body can be turned and coupled with the first layer to form a loop portion. The loop portion can be configured to receive a first hand of a user. In some aspects, the second strip attachment can be positioned on the loop portion and away from the second end.

In some aspects, the techniques described herein can relate to a swinging assist strap, wherein the first strip attachment and the second strip attachment can form a hook and loop system.

In some aspects, the techniques described herein relate to a swinging assist strap, wherein the first layer can include nylon webbing.

In some aspects, the techniques described herein relate to a swinging assist strap, wherein the second layer can include leather.

In some aspects, the techniques described herein relate to a swinging assist strap, wherein the second length can be about 40 percent of the first length.

In some aspects, the techniques described herein relate to a swinging assist strap that can further include a grip portion.

In some aspects, the techniques described herein relate to a swinging assist strap, wherein the grip portion can include two layers of nylon and one layer of leather.

In some aspects, the techniques described herein relate to a swinging assist strap, wherein the swinging assist strap can be used with a sport equipment that can be a baseball bat.

In some aspects, the techniques described herein relate to a combination that can include the swinging assist strap and the baseball bat.

In some aspects, the techniques described herein can relate to a sport equipment grabbing strap device for securing an arm of a player to a baseball bat. The sport equipment grabbing strap device can include a loop portion. The loop portion can include a first strip attachment and can be configured to receive a first hand of a user. The sport equipment grabbing strap device can include a grip portion. The grip portion can include a second attachment strip and can be configured to receive a second hand of the user. The loop portion and the grip portion can include a first layer having a first side and a second side. The loop portion and the grip portion can include a second layer having a first side and a second side.

In some aspects, the techniques described herein relate to a method of holding a sport equipment with two hands using a wearable device. The method can include securing a first hand in a first hand securement of the wearable device, the wearable device having an elongate grip portion extending from the first hand securement. The method can include placing the first hand around a sport equipment. The method can include placing a second hand around the sport equipment and the grip portion of the wearable device at a same time such that the second hand prevents movement of first hand relative to the second hand. The method can include applying or attempting to apply the sport equipment to an incoming object by swinging the sport equipment in a trajectory such that the first hand and the second hand move together through a completion of the trajectory.

In some aspects, the techniques described herein relate to a method, wherein the wearable device can further include a Velcro® system such that a hook of the Velcro® system on the grip portion can be coupled with a loop of the Velcro® system on the first hand securement.

In some aspects, the techniques described herein relate to a method that can further include a step of using the second hand to decouple the grip portion from the first hand securement.

In some aspects, the techniques described herein relate to a method, wherein the first hand securement can include a loop portion configured to receive the first hand.

In some aspects, the techniques described herein relate to a method, wherein the first hand securement can include a glove body.

In some aspects, the techniques described herein relate to a method, wherein the grip portion is integral with the glove body such that the grip portion and the glove body form a single component.

In some aspects, the techniques described herein relate to a method, wherein the grip portion is coupled with the first hand securement by way of buttons.

In some aspects, the techniques described herein relate to a method, wherein the sport equipment is a baseball bat.

In some aspects, the techniques described herein relate to a method, wherein the sport equipment is one or more of tennis racket, cricket bat, badminton racket, pickleball paddle, golf club, lacrosse pole, field hockey stick, ice hockey stick, or ping pong paddle.

In some aspects, the techniques described herein relate to a method wherein the first hand can include a first hand covering, and the second hand can include a second hand covering.

In some aspects, the techniques described herein relate to a method, wherein the first hand covering and the second hand covering can be a pair of gloves.

In some aspects, the techniques described herein relate to a method, wherein the incoming object can be a ball.

In some aspects, the techniques described herein relate to a method that can further include placing the first hand in a first hand covering device prior to positioning the first hand through the loop portion of the wearable device.

In some aspects, the techniques described herein relate to a method, wherein the method can be performed with at least one bare hand.

In some aspects, the techniques described herein relate to a method of assisting a user with a swing of sports equipment. The method can include placing a first hand in a first hand covering. The first hand covering can include an elongate grip portion extending from the first hand covering. The grip portion can be releasably connected to the first hand covering. In some aspects, the method can include placing the first hand covering on a sport equipment. In some aspects, the method can include using a second hand to decouple the grip portion from the first hand covering. In some aspects, the method can include placing a second hand on the grip portion of the first hand covering and the sport equipment at a same time such that the second hand holds the first hand against the sport equipment by way of the grip portion of the first hand covering. In some aspects, the method can include applying or attempting to apply the sport equipment to an incoming object by swinging the sport equipment in a trajectory such that the first hand and the second hand move together through a completion of the trajectory.

In some aspects, the techniques described herein relate to a method, wherein the grip portion of the first hand covering can be releasably connected to the first hand covering by way of a hook and loop system.

In some aspects, the techniques described herein relate to a method that can further include releasing the second hand from around the sport equipment and allowing the first hand to release the sport equipment when the second hand is released from around the sport equipment.

In some aspects, the techniques described herein relate to a method, wherein the grip portion can be releasably connected to the first hand covering by way of a hook and loop system.

In some aspects, the techniques described herein relate to a method of assisting a user with a swing of sports equipment using a strap device. The method can include placing a first hand through a strap device, wherein the strap device can include a loop portion and an elongate grip portion extending form the loop portion. The grip portion can be releasably connected to the loop portion. In some aspects, the method can include placing the first hand on a sport equipment. In some aspects, the method can include using a second hand to decouple the grip portion from the loop portion. In some aspects, the method can include placing a second hand on the grip portion of the strap device and the sport equipment at a same time such that the second hand holds the first hand against the sport equipment by way of the grip portion of the strap device. In some aspects, the method can include applying or attempting to apply the sport equipment to an incoming object by swinging the sport equipment in a trajectory such that the first hand and the second hand move together through a completion of the trajectory.

In some aspects, the techniques described herein relate to a method of securing a first hand to a sport equipment using a second hand. The method can include securing a strap device to a first hand. In some aspects, the method can include placing the first hand on a sport equipment. In some aspects, the method can include placing a second hand on the sport equipment and the strap device such that the second hand secures the first hand to the sport equipment. In some aspects, the method can include allowing release of the first hand from the sport equipment when the second hand releases the strap device.

DETAILED DESCRIPTION

Various sports equipment strap device apparatuses, systems, and methods are described. Certain aspects are described in the context of a strap device configured to be used with a hand covering piece (such as a pair of gloves) and/or a sport equipment (such as a bat) in baseball or softball due to particular utility in that context. However, the technology disclosed herein can also be applied to other types of sport equipment, such as tennis racket, cricket bats, badminton racket, pickleball paddles, golf clubs, lacrosse poles, field hockey sticks, ice hockey sticks, ping pong, or any other sport that requires both hands of a user to follow through a motion after contacting (or attempting to contact) another object (such as a ball). No features, structure, or step disclosed herein is essential or indispensable.

Figure 1:
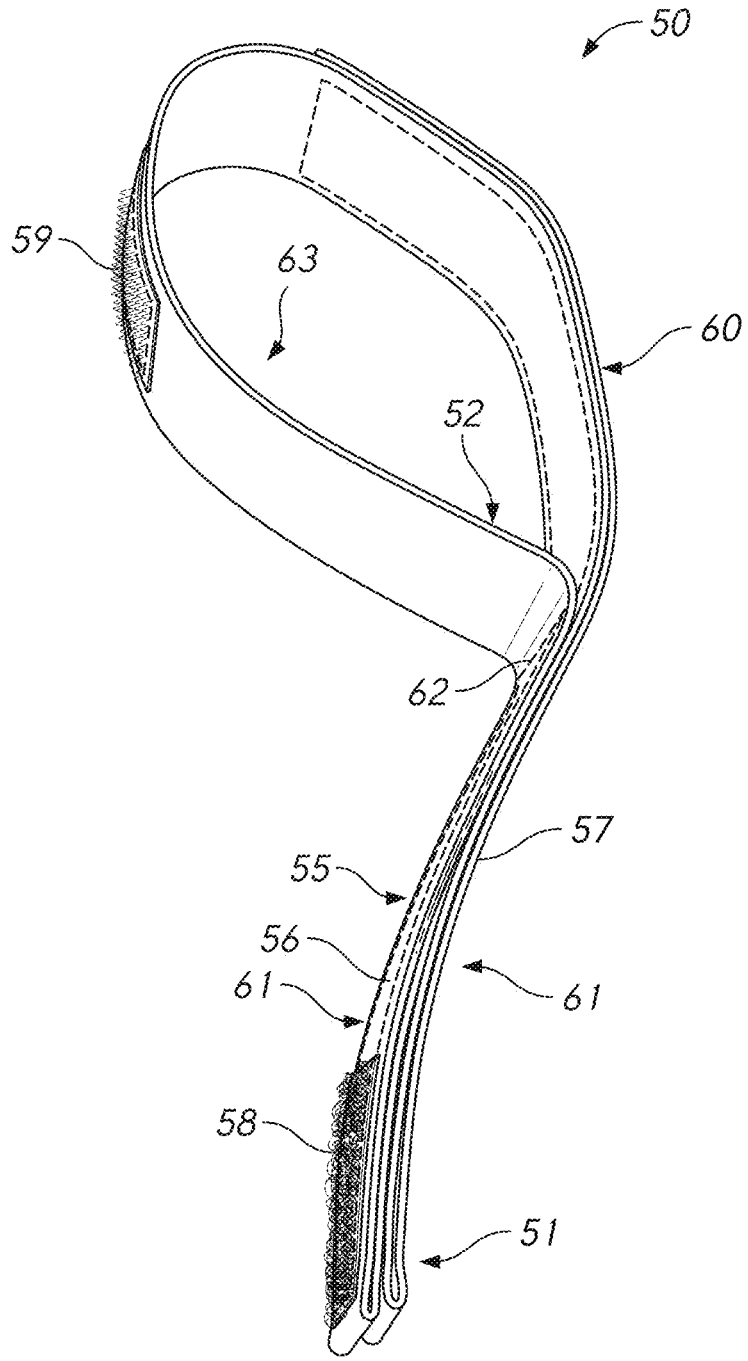
FIG. 1 illustrates a perspective view of an aspect of a strap device.

FIG. 1 illustrates a perspective view of an aspect of a strap device 50 according to one aspect of the present disclosure. The strap device 50 can include a strip 55. In some aspects, the strip 55 can include a thin body. In some aspects, the strip 55 can include an elongate body and can be a generally narrow article with a small width compared to its length. The strip 55 can be manufactured of various sizes (corresponding to various widths, thickness, or lengths dimensions) to accommodate a user's need. For example, the strip 55 can have a width of about 1.5 inches or about 2 inches inch or about 2.5 inches inch or about 2.75 inches inch or any number or fraction of a number smaller than about 1.5 inches or larger than about 2.75 inches. The strip 55 can have a width that is constant or variable. For example, the strip 55 can have a width that is about 2 inches inch at the first portion and a width that is about 2.75 inches inch at the second portion. In some aspects, the strip 55 can turn to form a loop portion 60. In some aspects, the strip 55 can include a lower grip portion 61 (also referred to as the grip portion 61) and an upper grip portion 63. The grip portion 61 and the upper grip portion 63 can have an elongate body. In some aspects, the strip 55 can have a width that is larger at the loop portion 60 (or upper grip portion 63) than the lower grip portion 61. For example, the strip 55 can form a flare portion at the loop portion 60 and/or lower grip portion 61. The strip 55 can have a length of about 8 inches or about 10 inches or about 14 inches or about 14.5 inches or any number or fraction of a number smaller than about 8 inches or larger than about 14.5 inches. Depending on what an optimal length and width is for a particular application to maintain a certain hand position with regard to a sports equipment, a person of skill will understand that the presently disclosed device and can have dimensions more or less than those provided above to accommodate the specific grip needs for a particular sport or sports equipment. The strip 55 can have a first end 51 and a second end 52. The first end 51 can be positioned on one end of the strip 55. The second end 52 can be positioned on the opposite end of the strip 55.

The strip 55 can include a first side and a second side. In some aspects, the strip 55 can include a first layer 56 and a second layer 57. The first layer 56 can be positioned on the first side of the strip 55 and the second layer 57 can be positioned on the second side of the strip 55. In use, the first side of the strip 55 can contact the hand of the user (or a hand covering device), and the second side of the strip 55 can contact the sport equipment. In some aspects, the first layer 56 and the second layer 57 can be positioned directly against each other. The first layer 56 and the second layer 57 can be coupled to each other through a variety of means. In some aspects, the first layer 56 is sewn to the second layer 57. In some aspects, the first layer 56 and the second layer 57 are connected to one another with adhesive. Although the first layer 56 and the second layer 57 may be manufactured with spaces (or gap) therebetween, different aspects of the strap device 50 of the present disclosure may be manufactured with or without a space between the first layer 56 and the second layer 57. The strip 55 can have a thickness that is constant or variable. In general, the thickness of any particular layer can be selected in accordance with the desired end properties of the strip or based on the user's need (for example to provide strength while balancing against the need for grip). For example, the strip 55 can have a thickness of about 0.5 millimeter or about 1 millimeter or about 1.2 millimeters or about 1.5 millimeters or about 1.75 millimeters or about 2 millimeters or about 2.5 millimeters or any other thickness smaller than about 0.5 millimeters or larger than about 2.5 millimeters depending on the user's need. The thickness of the strip 55 can be the thickness of the first layer 56 and the second layer 57 and other additional layer(s) plus any space and/or gap in between each layer. The first layer 56 and the second layer 57 can be manufactured from a variety of materials. For example, the first layer 56 and/or the second layer 57 can be manufactured from leather, silicone, rubber, neoprene (polychloroprene), nylon, spandex, cotton, polyester, other fabric materials, webbings, etc. In some aspects, the first layer 56 can include 1 inch nylon webbing. In some aspects, the second layer 57 can include leather with a thickness of about 1.2 millimeters. In some aspects, the leather can be cowhide leather. Consequently, the strip 55 can be manufactured to have rigid or flexible characteristics depending on the user's needs. In some aspects, the strip 55 and/or other components of the strap device 50 can be provided as a roll. The material(s) used to manufacture the strip 55 can be selected in such a way to assist with stabilizing and securing the sport equipment when the user holds the sport equipment (such as, for example, to provide grip and flexibility).

In some aspects, the first layer 56 can include a thin material layer and the second layer 57 can include a thick material layer. For example, the first layer can include a thin layer comprising a thin layer of nylon webbing and the second layer can include a thick layer comprising a thick layer of leather. In some aspects, the second layer does not cover the entirety of the first layer or vice versa. For example, the second layer can have a length that is about 70% of the length of the first layer. In other aspects, the length of the second layer can be about 40% or about 60% or about 75% or about 80% or any number or fraction of a number smaller than about 40% or larger than about 80%. In some other aspects, the first layer can have a length that is about 70% of the length of the second layer. In some aspects, the length of the first layer can be about 75% or 80% or any number or fraction of a number smaller than 70% or larger than 80% of the second layer. Other combinations of one or more material layers with different lengths can also be used to accommodate a user's need. Accordingly, the strip 55 can have a thickness that is the same or substantially the same throughout its length or it can have an overall thickness that varies through the length of the strip. In some aspects, the first layer 56 and the second layer 57 can have a same or similar width. In some other aspects, the first layer 56 and the second layer 57 can include different widths so that the two layers do not overlap against each other. Each of the first layer 56 and the second layer 57 can include a first and a second side opposite the first side. The strip 55 (and consequently each of the first layer 56 and the second layer 57) can have a first end and a second end opposite the first end.

Figure 4:
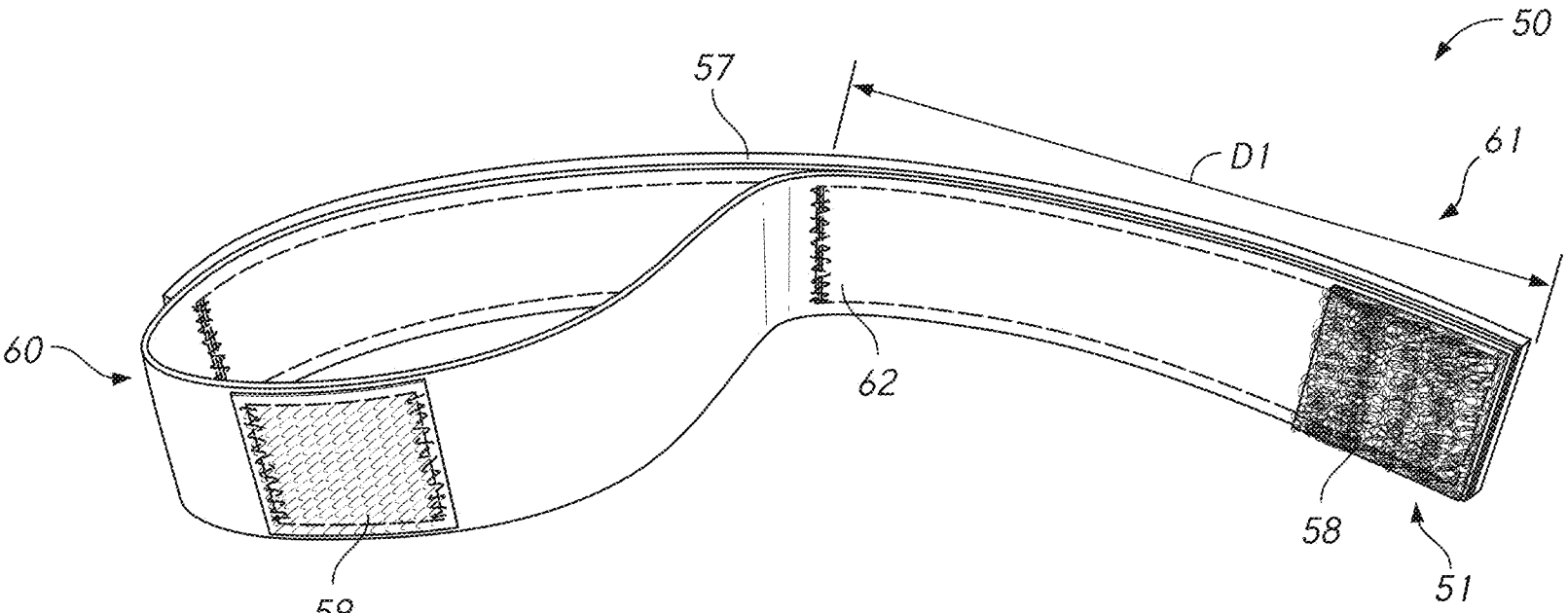
FIG. 4 illustrates another side view of an aspect of the strap device in an open position.

Still referring to FIG. 1, the strip 55 can turn to form a loop portion 60 that can be configured to accommodate a user's hand. In some aspects, the loop portion 60 can be formed by coupling the second end 52 to a loop end 62 positioned on the strip 55. The second end 52 can be coupled to the loop end 62 through a variety of means. For example, the second end 52 can be sewn or otherwise connected with a hook and loop Velcro® fastening system or other acceptable mechanisms. The loop end 62 can be positioned in a variety of different locations along the strip 55 to accommodate a user's need. For example, a user with a larger hand may require a larger loop. In some aspects, the closer the loop end 62 is to the first end 51, the larger the loop portion 60 can be. In some aspects, once the second end 52 is coupled with first layer 56 at the loop end 62, the strap device 50 can form a shape that generally looks like the number 9. In some aspects, the second end 52 can contact the strip 55 at the loop end 62 or run the entire the length to the first end 51 or anywhere in between. For example, in some aspects, the second end 52 can turn and be coupled with the first end 51 in a way that the first layer 56 of the first end 51 contacts the first layer 56 of the second end 52. The first end 51 and the second end 52 can overlap to form a grip length D1 (as illustrated in FIG. 4). The grip length D1 can correspond to the length of a grip portion 61. The grip length D1 can correspond to the length between the first end 51 and the loop end 62. In some aspects, the grip length D1 includes a first layer 56. In some other aspects, the grip length D1 includes a first layer 56 that is turned and placed against the first layer 56 at the first end to form a two-layer overlap portion. For example, if the first layer 56 includes nylon, and the second layer 57 includes leather, the grip portion 61 can include two layers of nylon and at least one layer of leather at the first end and/or along the grip length D1.

Figure 2:
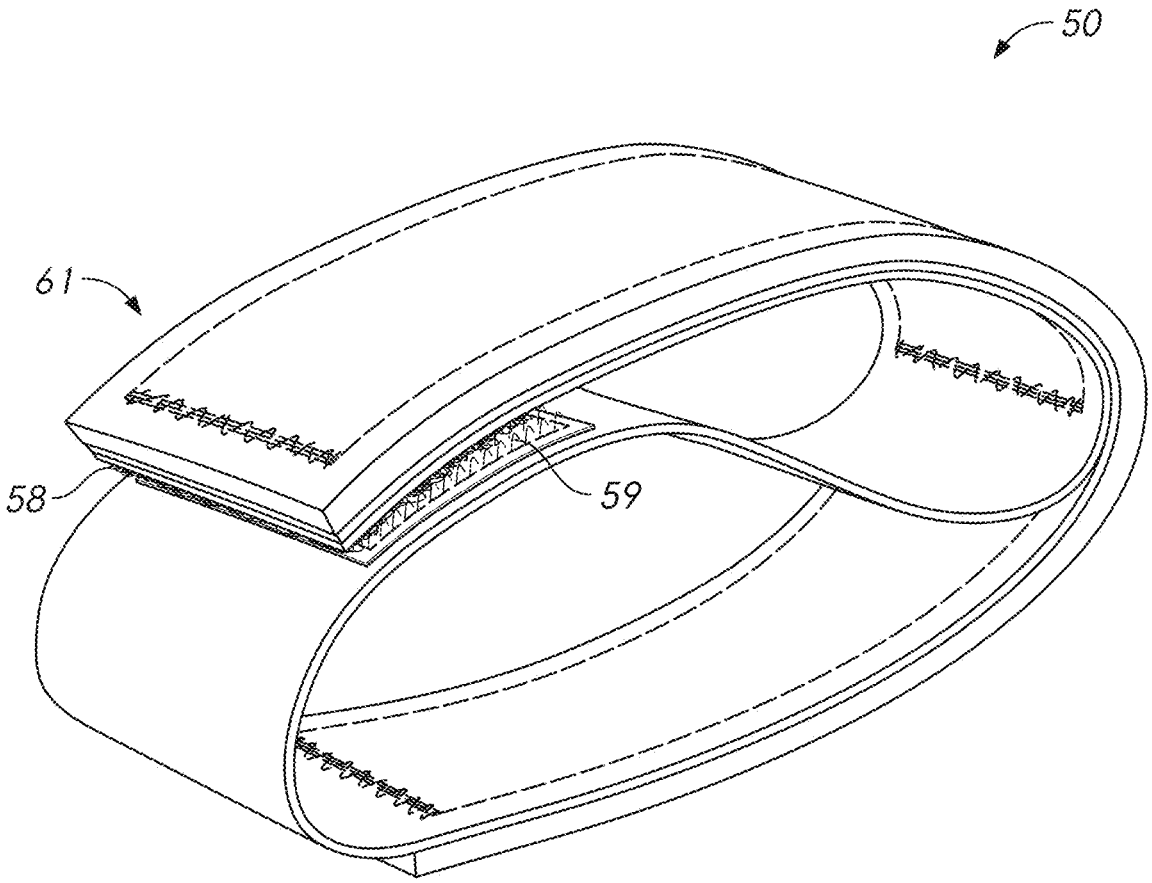
FIG. 2 illustrates a perspective view of an aspect of the strap device of FIG. 1 in a closed position.

With continued reference to FIG. 1, in some aspects, the strap device 50 can include a first strip attachment 58 positioned on the first end 51. In some aspects, the first strip attachment 58 can couple to (or mate with) a second strip attachment 59. In some aspects, the first strip attachment 58 and the second strip attachment 59 can form a hook and loop Velcro® fastening system. This arrangement can allow the user to further secure and retain the grip portion 61 of the strap device 50 in the first hand covering 70. In some other aspects, the first strip attachment 58 and second strip attachment 59 can form a hook and loop Velcro® fastening system such that once the first strip attachment 58 and second strip attachment 59 are coupled together, the strap device 50 can have a generally round overall shape as it is illustrated in FIG. 2. This arrangement can have an advantage of compacting the overall space that the strap device 50 occupies when the strap device 50 is not in use. In some aspects, the first strip attachment 58 can be positioned on the first end, and the second strip attachment can be positioned on the loop portion 60. In some aspects, the first strip attachment 58 can be positioned on the first end 51, and the second strip attachment can be positioned on a second hand covering 80 (as it will be discussed in more details below).

FIG. 2 illustrates a perspective view of an aspect of the strap device 50 of FIG. 1 in a closed position. In the closed portion, the first strip attachment 58 and the second strip attachment 59 can be used to couple the grip portion 61 with the loop portion 60. In the closed position, the strap device 50 can form a generally round overall shape.

Figure 3:
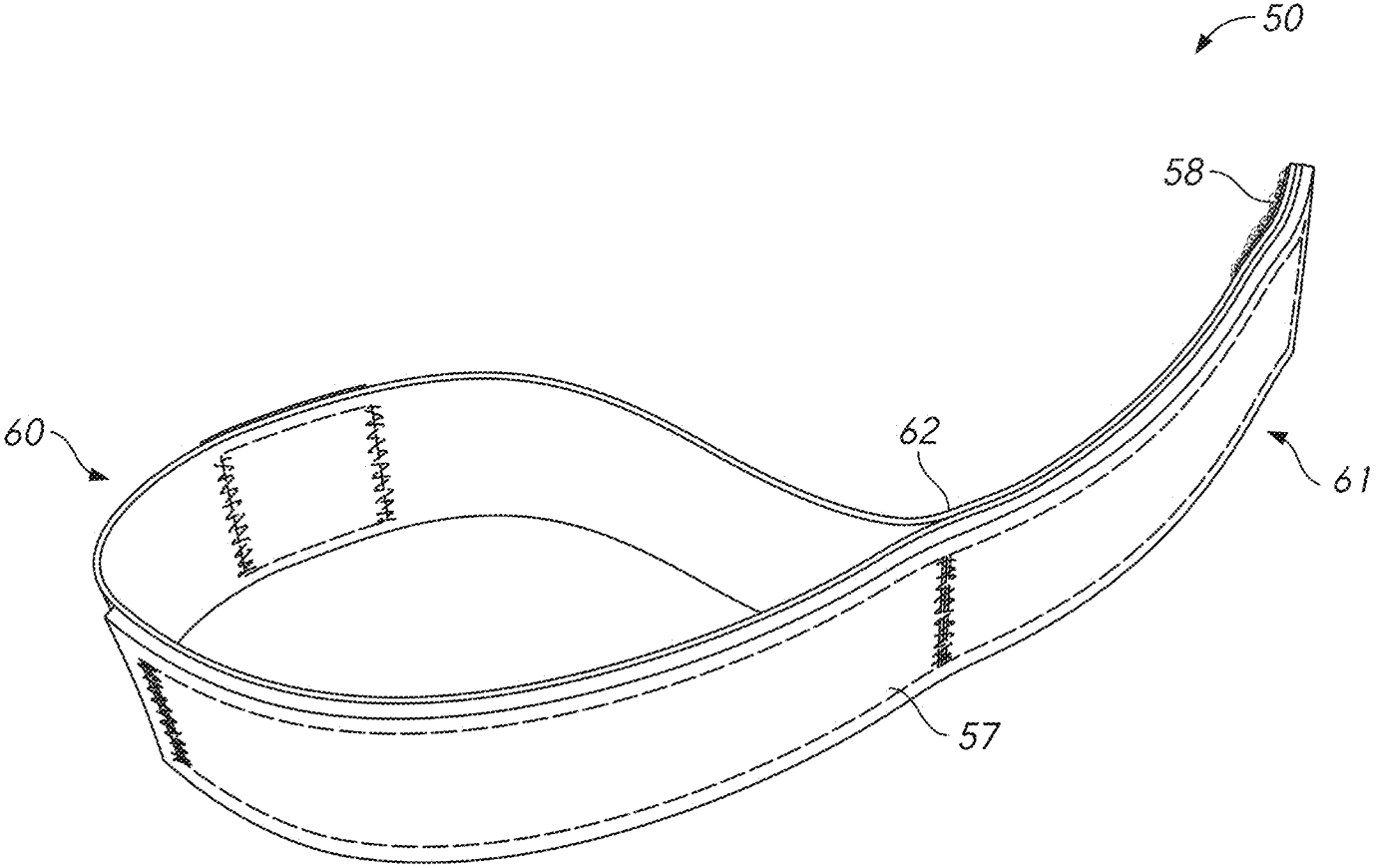
FIG. 3 illustrates a side view of an aspect of the strap device in an open position.

FIG. 3 illustrates a side view of an aspect of the strap device 50 in an open position. In the open position, the first strip attachment 58 and the grip portion 61 are positioned away from the loop portion 60 and the second strip attachment 59. As discussed earlier, the loop portion 60 can be formed by way of coupling the first layer 56 at the loop end 62. In some aspects, the loop end 62 can be configured to couple the first layer 56 with the first layer 56. In other aspects, the loop end 62 can be configured to couple the first layer 56 with both the first layer 56 and the second layer 57.

FIG. 4 illustrates another side view of an aspect of the strap device 50 in an open position. In the open position, the first strip attachment 58 and the grip portion 61 are positioned away from the loop portion 60 and the second strip attachment 59. The loop portion 60 can be formed by way of coupling the first layer 56 at the loop end 62. In some aspects, the loop end 62 can be configured to couple the first layer 56 with only the first layer 56 while in other aspects, the first layer 56 can be coupled with both the first layer 56 and second layer 57. As discussed earlier, the first end 51 and the second end 52 can overlap to form a grip length D1. The grip length D1 can correspond to the length of a grip portion 61. The grip length D1 can correspond to the length between the first end 51 and the loop end 62. In some aspects, the grip length D1 includes a first layer 56 and a second layer 57. In some other aspects, the grip length D1 includes a first layer 56 that is turned and placed against the first layer 56 at the first end 51 to form a two-layer overlap portion. For example, if the first layer 56 includes nylon, and the second layer 57 includes leather, the grip portion 61 can include two layers of nylon and one layer of leather at the first end 51 and/or along the grip length D1.

Figure 5:
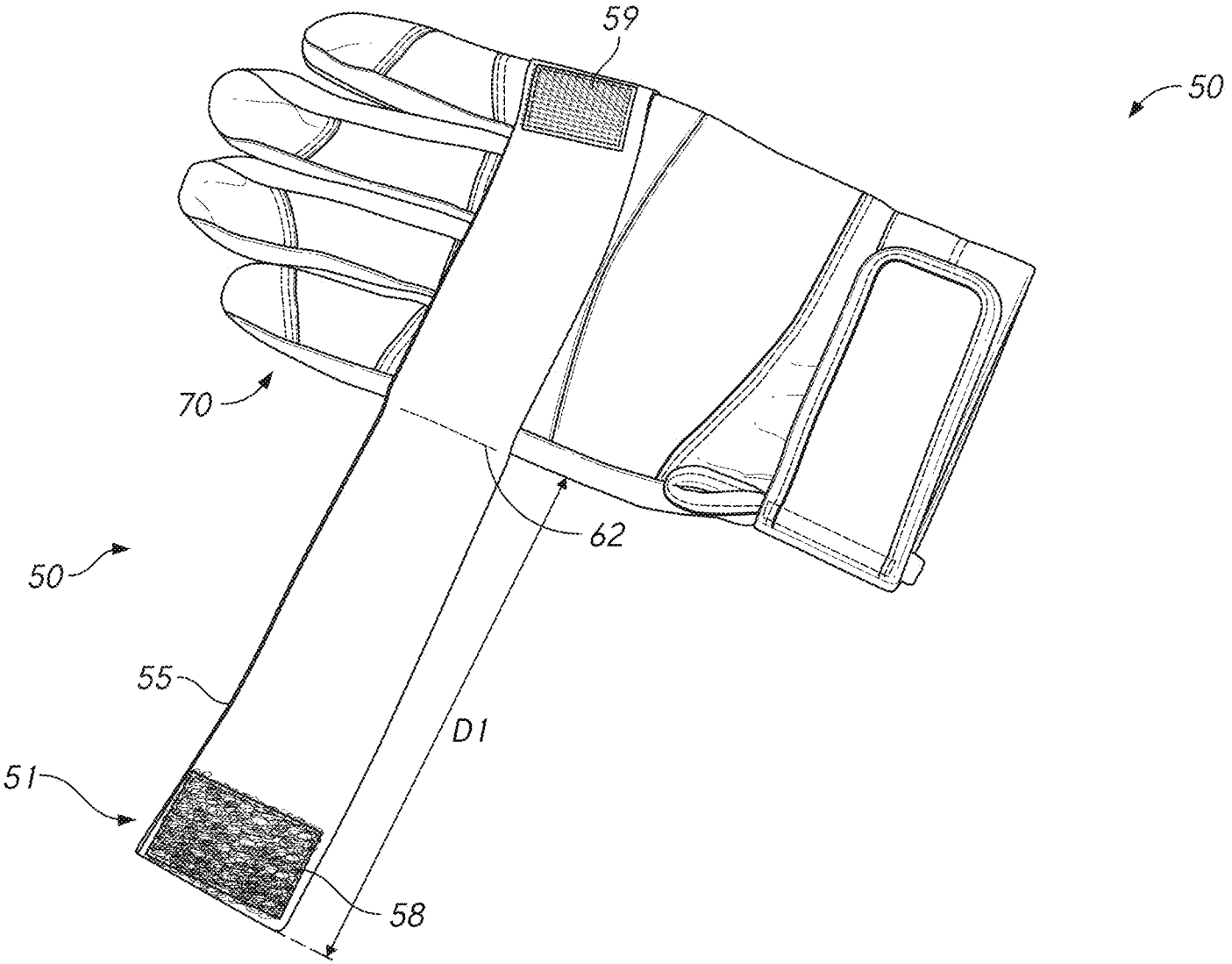
FIG. 5 illustrates a top view of an aspect of the strap device that is configured to be used with (or manufactured with) a hand covering piece.

FIG. 5 illustrates a top view of an aspect of the strap device 50 that is configured to be used (or manufactured) with a first hand covering 70 in an open position. In this aspect, at the loop end 62, the strip 55 is sewn, and the first hand covering 70 is positioned through the loop portion 60 (see FIG. 6) that is created as a result. As discussed earlier, in the open position, the first strip attachment 58 and the grip portion 61 are positioned away from the loop portion 60 and the second strip attachment 59. A grip length D1 can be seen, correspond to the length between the first end 51 and the loop end 62. In some aspects, the first hand covering 70 can be a glove, such as a batting glove. In other aspects, other types of hand covering accessories that are used for different sports (e.g., golf gloves, cricket batting gloves, etc.) can be used with the strap device 50. The strap device 50 can be used with or without a first hand covering 70 or a second hand covering 80. For example, the user can position their bare hand(s) directly through the loop portion 60 without wearing any hand covering.

Figure 6:
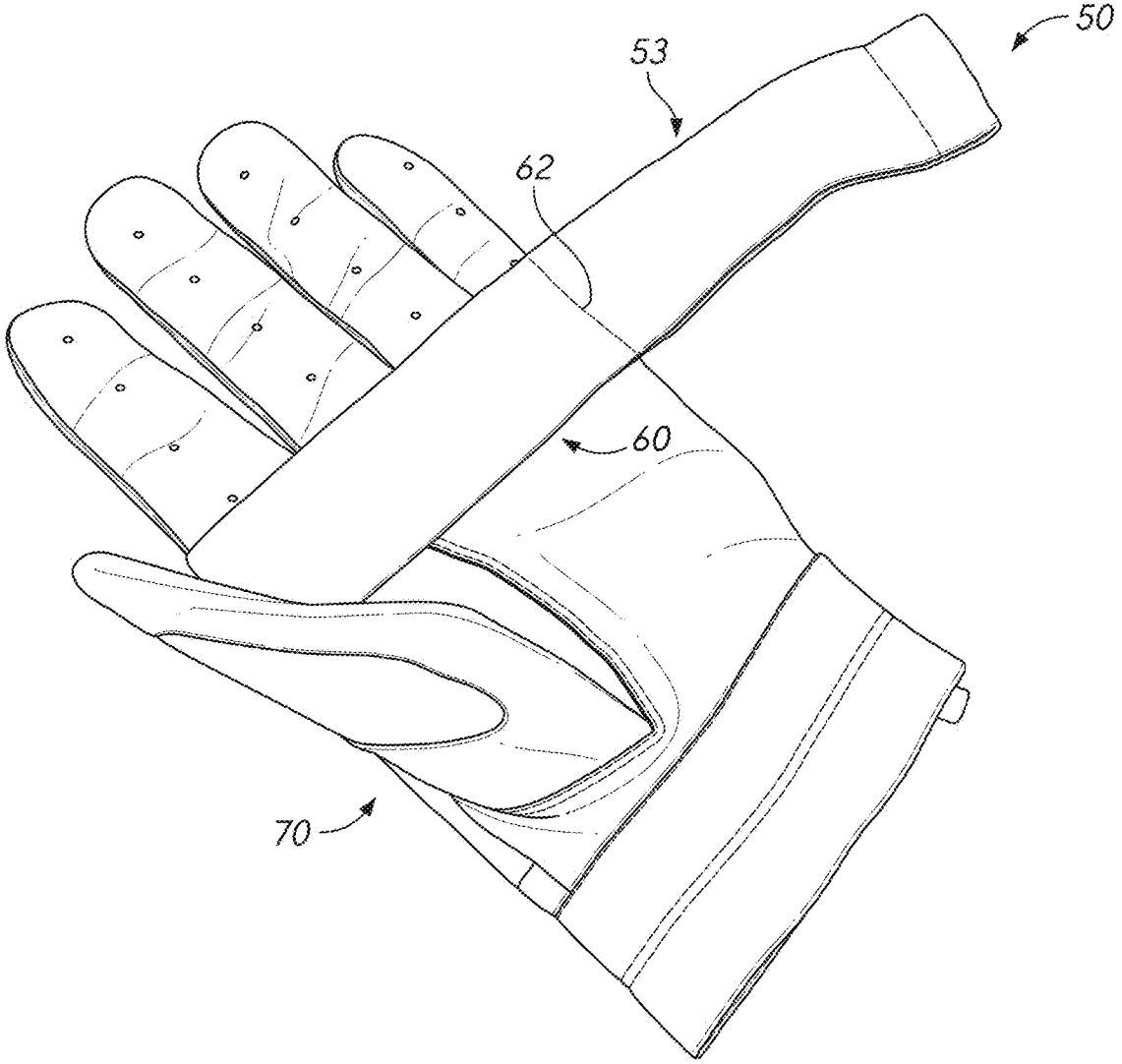
FIG. 6 illustrates another top view of an aspect of the strap device that is configured to be used with (or manufactured with) a hand covering piece.

FIG. 6 illustrates another top view of an aspect of the strap device 50 that is configured to be used (or manufactured)

with a hand covering piece. The first hand covering 70 can be seen positioned inside the loop portion 60 (see FIG. 1) of the strap device 50. As discussed earlier, the size of the loop portion 60 can be adjusted, and the strap device 50 can be manufactured in different sizes to accommodate the users' needs. In some aspects, the size of the loop portion 60 can be adjusted by positioning the loop end 62 closer to the first end 51. In some aspects, the strip 55 is manufactured from flexible material and the size of the loop portion 60 can be adjusted as the user inserts their first hand through the loop portion 60. The loop portion 60 can include an upper grip portion 63. In use, the upper grip portion 63 can be sandwiched between the first hand of the user (or the first hand covering 70) and the sport equipment. As it will be discussed further below, the strap device 50 can be manufactured with or without the loop portion 60. For example, the grip portion 61 can be secured to the first hand covering 70 without the need for the loop portion 60.

Figure 7:
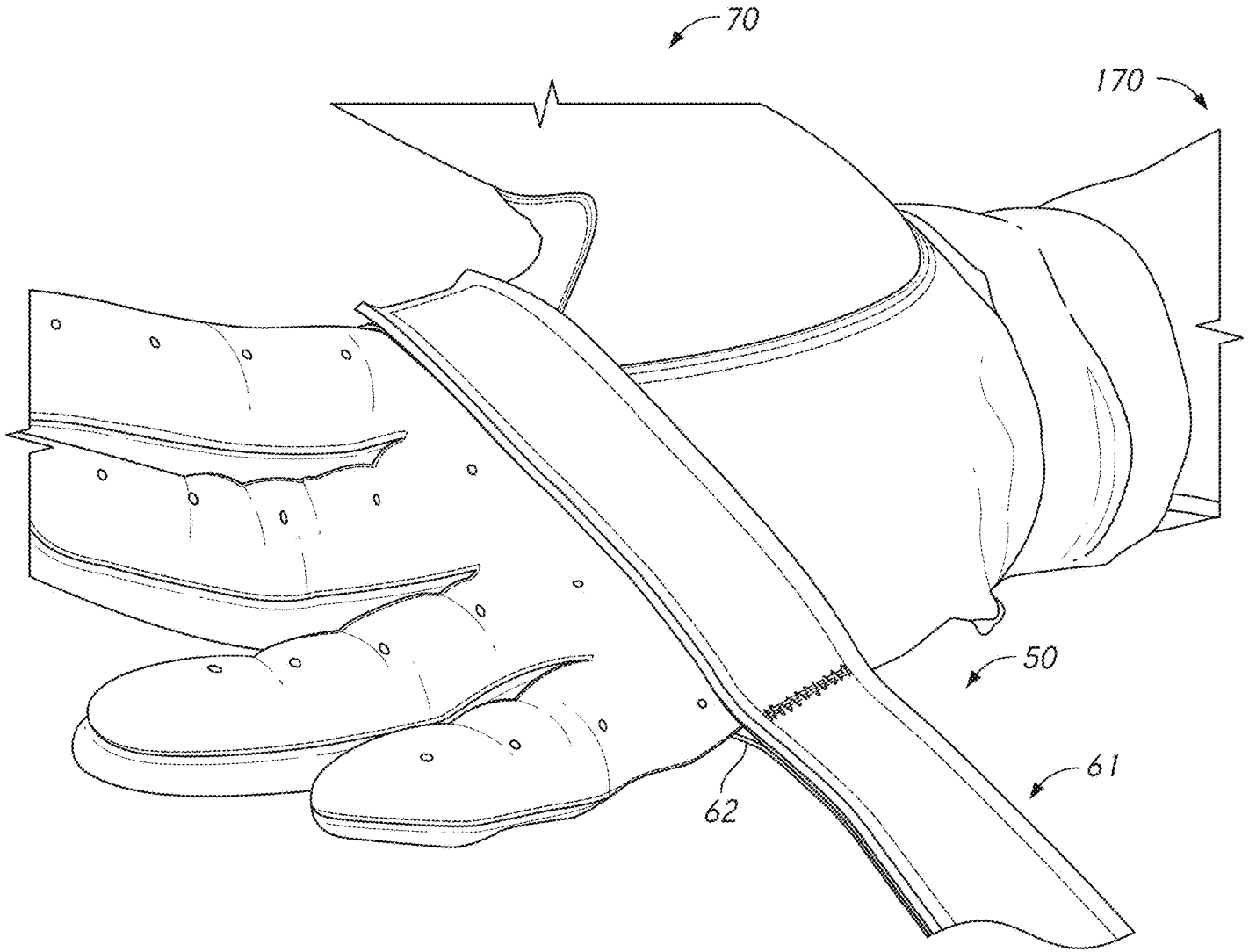
FIG. 7 illustrates an aspect of the strap device in use.

FIG. 7 illustrates an aspect of the strap device 50 in use. As it can be seen, a first hand 170 of the user is placed in a first hand covering 70, and the first hand covering 70 is placed in the loop portion 60. In one aspect, the position of the loop end 62 can correspond to the opening size of the loop portion 60. For example, the closer the loop end 62 is to the first end 51, the larger the opening size of the loop portion 60 is. The larger opening size of the loop portion 60 can subsequently accommodate users with larger hands. As illustrated in FIG. 7, the grip portion 61 is positioned away from the first hand covering 70, and the strap device 50 is in an open position.

Figure 8A:
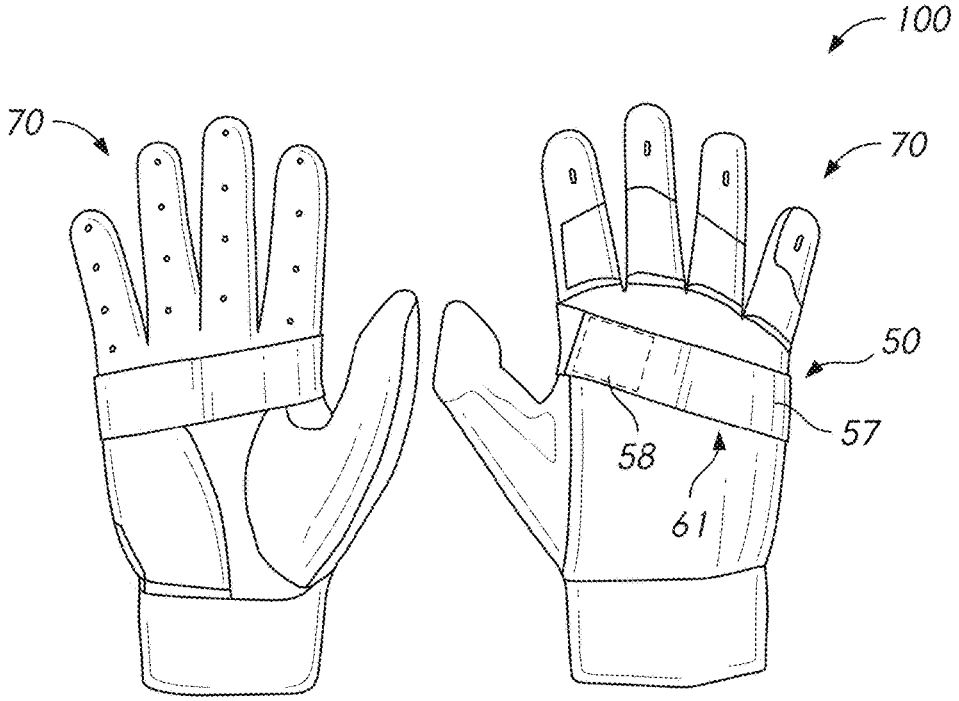
FIG. 8A illustrates an aspect of the strap device in use with a hand covering device in a closed position.
Figure 8B:
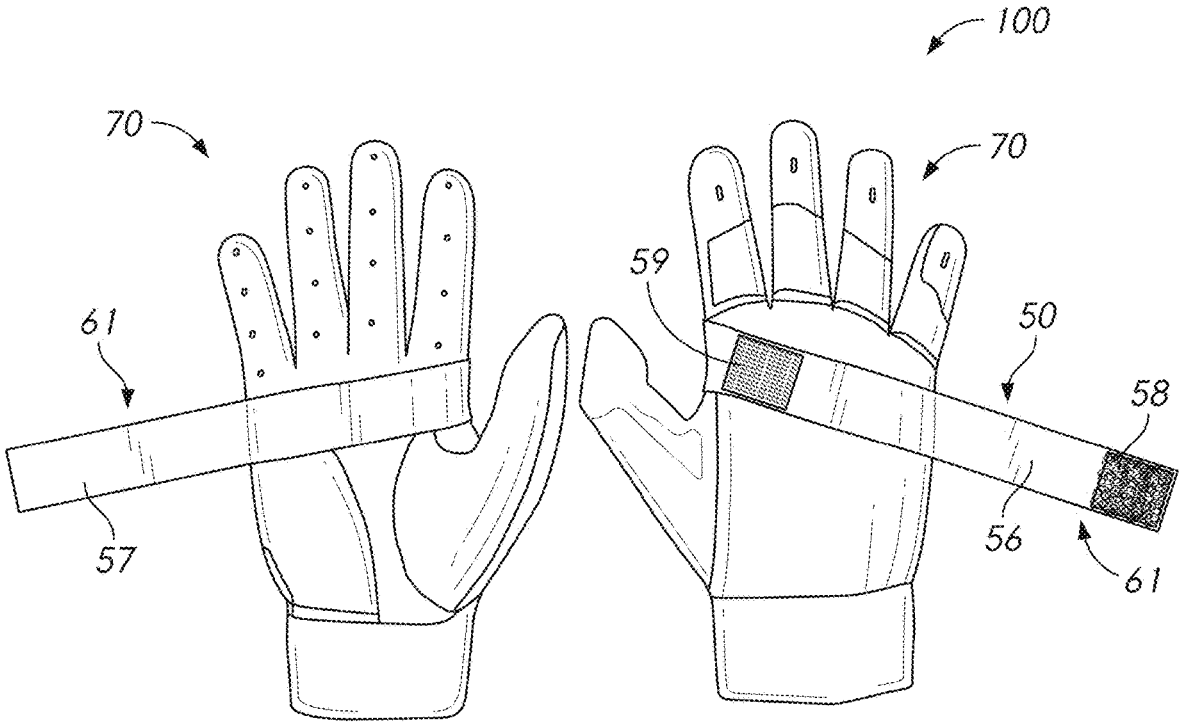
FIG. 8B illustrates an aspect of the strap device in use with a hand covering device in an open position.

FIG. 8A illustrates an aspect of the strap device 50 in use in an assembly 100 with a first hand covering 70 in a closed position, and FIG. 8B illustrates an aspect of the strap device 50 in use with a first hand covering 70 in an open position. As it can be seen in the closed position illustrated in FIG. 8A, the grip portion 61 is coupled with the first hand covering 70. In some aspects, the first strip attachment 58 can mate with the second strip attachment 59 to facilitate coupling the grip portion 61 with the first hand covering 70. On the other hand, in the open position illustrated in FIG. 8B, the grip portion 61 is positioned away from the first hand covering 70.

Figure 9A:
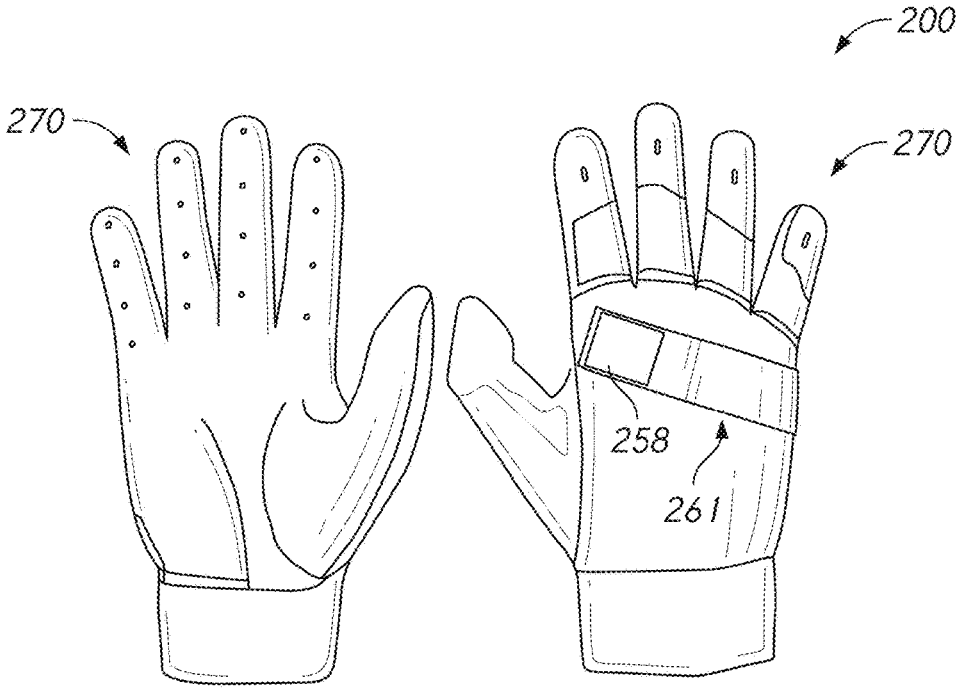
FIG. 9A illustrates another aspect of a strap device without a loop portion in use with a hand covering device in a closed position.
Figure 9B:
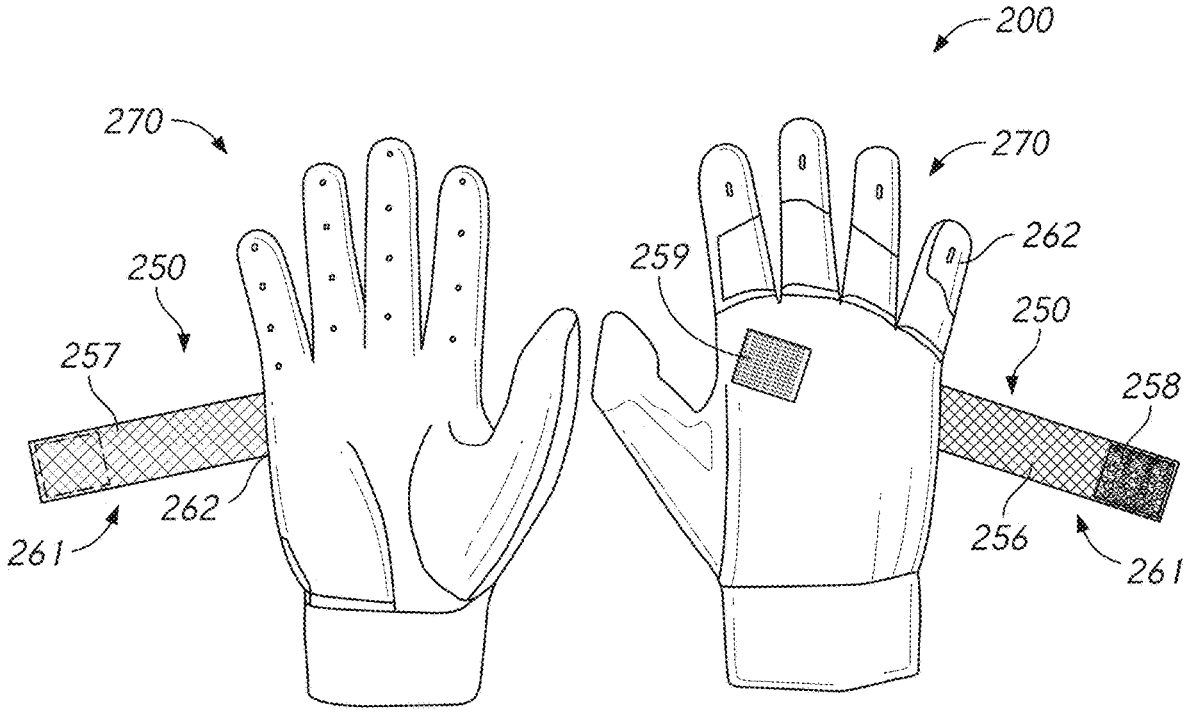
FIG. 9B illustrates another aspect of the strap device of FIG. 9A in use with a hand covering device in an open position.

FIG. 9A illustrates an aspect of a strap device 250 in use in an assembly 200 with a first hand covering 270 in a closed position, and FIG. 9B illustrates an aspect of the strap device 250 in use with the first hand covering 270 in an open position. In some aspects the assembly 200 can be a wearable device. In some aspects, the assembly 200 can include a first hand securement that can be configured to secure the first hand of a user to a sport equipment utilizing a second hand of the user. As it can be seen in the closed position illustrated in FIG. 9A, a grip portion 261 is coupled with the first hand covering 270. More specifically, a loop portion (similar to the loop portion 60) can be eliminated, and the grip portion 261 can be coupled directly with the first hand covering 270 at a loop end 262. In some aspects, the first strip attachment 258 can mate with the second strip attachment 259 to facilitate coupling the grip portion 261 with the first hand covering 270 in the closed position. On the other hand, in the open position illustrated in FIG. 9B, the grip portion 261 is positioned away from the first hand covering 270. In some embodiments, similar to the embodiments of the strap device 50 illustrated in FIG. 1, the grip portion 261 can include a first layer 256 and a second layer 257.

In some aspects, the strap device 50 can be manufactured as a stand-alone piece that can be used in conjunction with other sport equipment. For example, the user can acquire the strap device 50 separately and use it in conjunction with a pair of gloves from a manufacturer of their choice. In some other aspects, the strap device 50 can be factory-sewn to the first hand covering 70. For example, once the user acquires a pair of gloves, the strap device 50 is already sewn (or otherwise attached through another mechanism) to a glove.

Figure 10B:
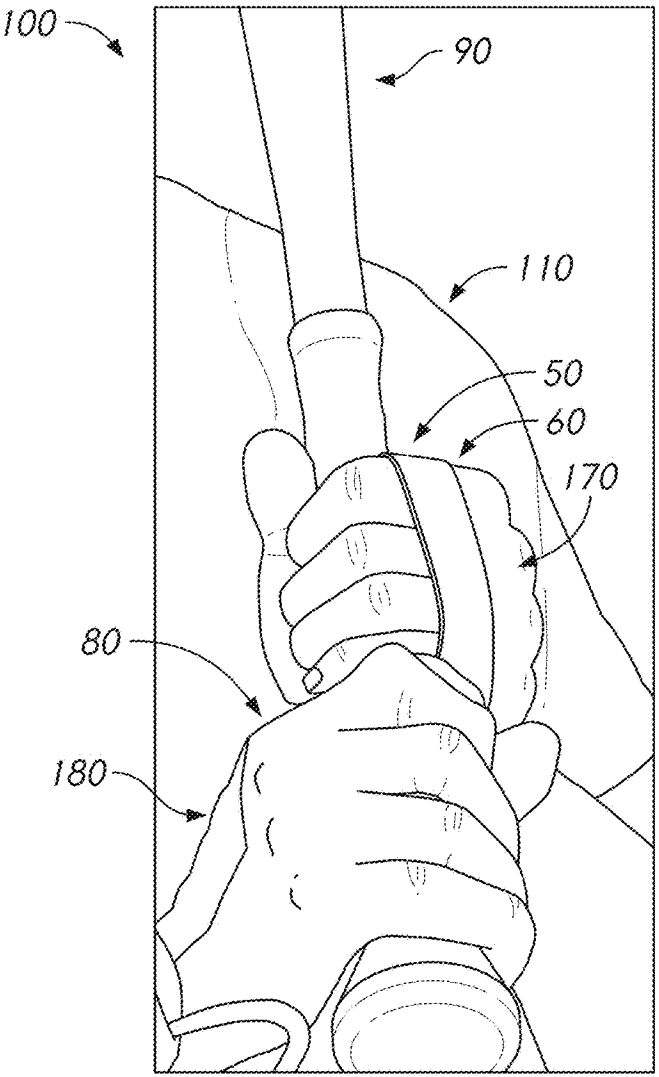
FIG. 10B illustrates a user holding a sport equipment with a and covering device.
Figure 10A:
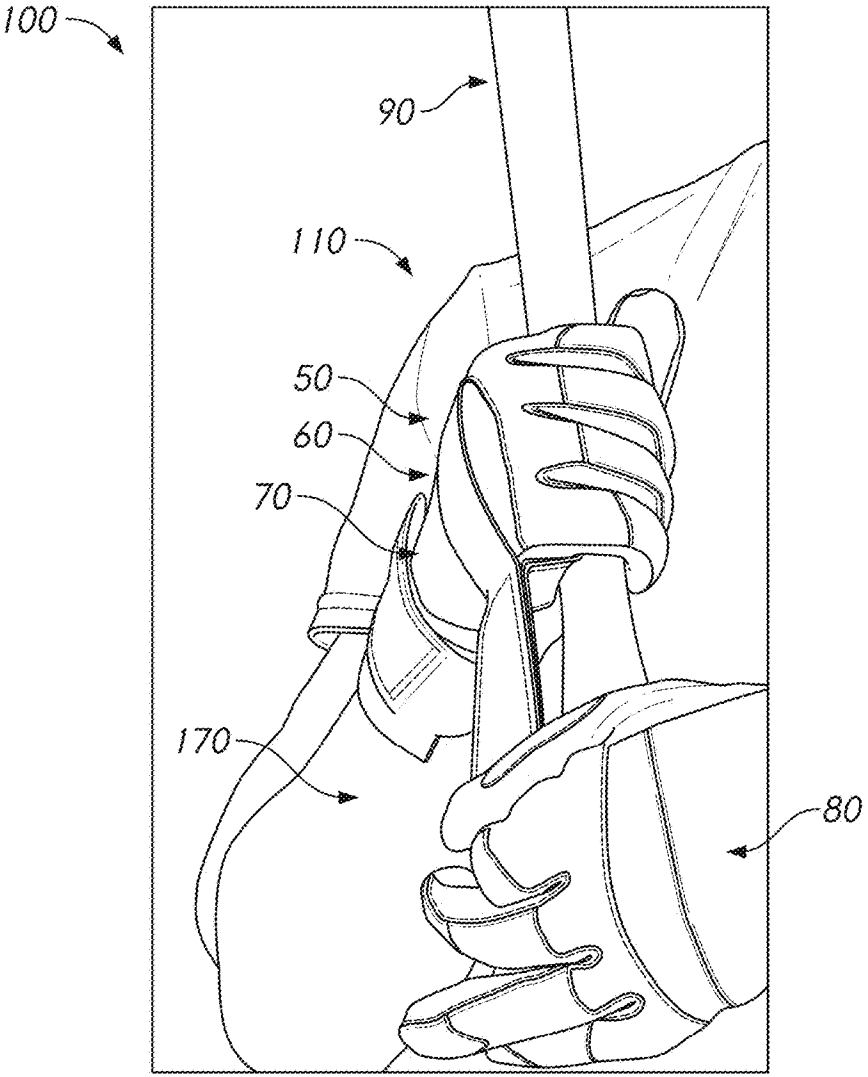
FIG. 10A illustrates an aspect of the strap device in use with a hand covering device and a sport equipment in an open position.

FIG. 10A-10B illustrate the assembly 100, including an aspect of the strap device 50 in use with a first hand covering 70 and a sport equipment 90 in an open position. As illustrated in FIG. 10A, a first hand 170 of the user 110 is positioned in the first hand covering 70 and through the loop portion 60 of the first hand covering 70. The user can place the first hand covering 70 through the loop portion 60 and on the sport equipment 90. In some aspects, the user 110 can use the second hand covering 80 to decouple the grip portion 61 from the loop portion 60. A second hand 180 can be placed in the second hand covering 80. The second hand covering 80 can be placed on the sport equipment 90 such that the second hand covering 80 squeezes the grip portion 61 against the sport equipment 90. This can allow the user to secure the first hand 170 to the sport equipment 90 throughout a swinging motion utilizing the second hand 180. In some aspects, as illustrated in FIG. 10B, the user can utilize a bare first hand, such as the first hand 170 to operate the strap device 50. It is appreciated that while several aspects of the device(s) of the present disclosure are illustrated with a hand covering device (such as the first hand covering 70 and/or the second hand covering 80), any and all aspects of the device(s) of the present disclosure can be used with or without a hand covering device and/or in any combination. As another example, in some aspects, the user can wear a hand covering on a first hand while using a second bare hand (or vice versa). For example, the first hand 170 can be a bare hand without utilizing a first hand covering while the second hand 180 is placed on the sport equipment 90 with a second hand covering 80.

Figures 11A, 11B, 11C:
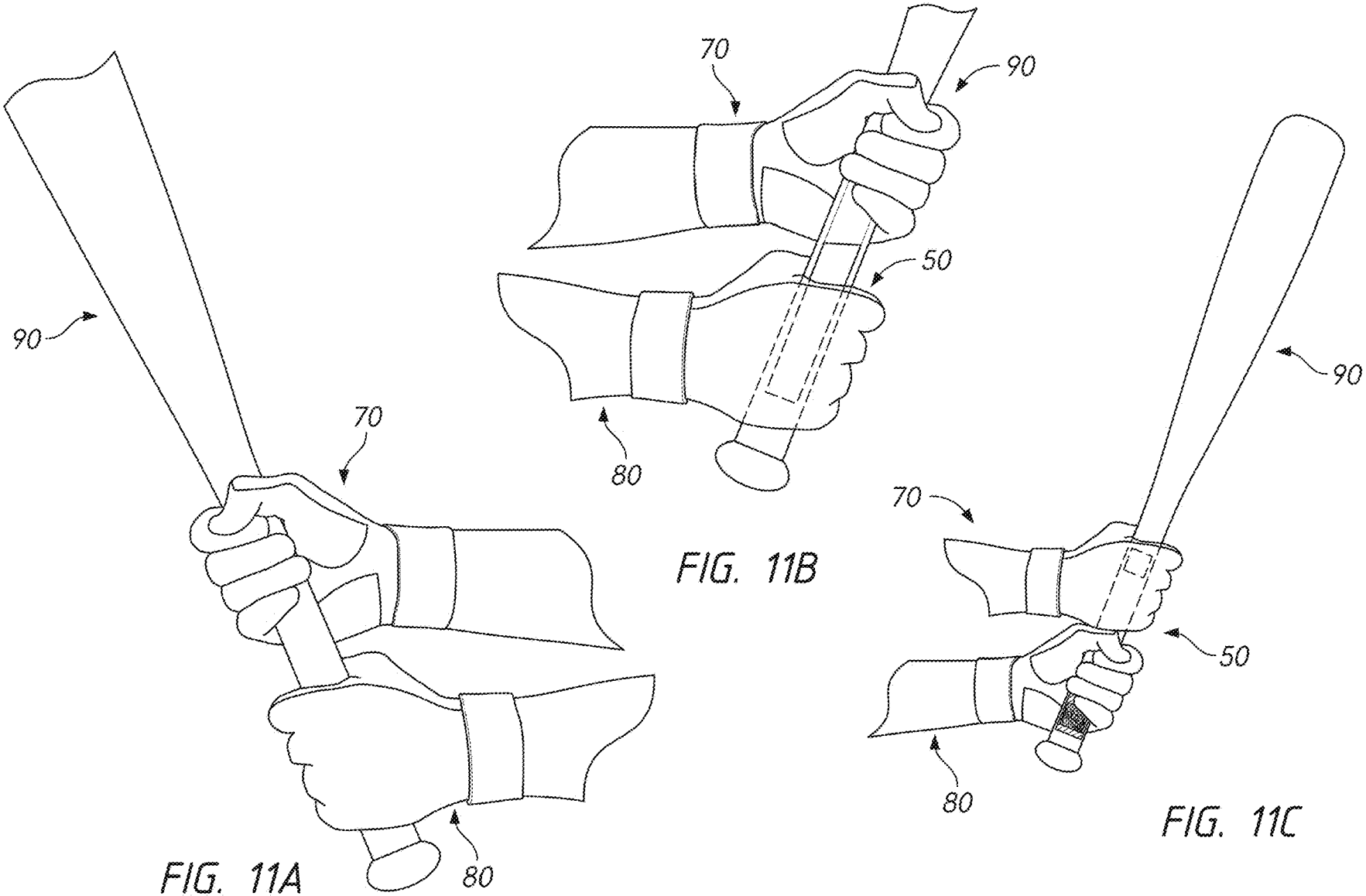
FIG. 11A illustrates a user holding a sport equipment with a and covering device.
FIG. 11B illustrates a side view of a user holding a sport equipment with a and covering device and the strap device according to one aspect of the present disclosure.
FIG. 11C illustrates another side view of a user holding a sport equipment with a and covering device and the strap device according to one aspect of the present disclosure.

FIG. 11A-C illustrate the operation of using the strap device 50 with a sport equipment 90 and a covering device. For illustration purposes, FIG. 11A illustrates the user placing the first hand covering 70 and the second hand covering 80 on the sport equipment 90 without showing the strap device 50. FIG. 11A and FIG. 11B illustrate different side views of the user holding the sport equipment 90 with the first hand covering 70 and the second hand covering 80. In some aspects, the first hand covering 70 is placed through a loop portion (not shown) prior to holding the sport equipment 90. In some aspects, the grip portion 61 is directly coupled with the first hand covering 70. The second hand covering 80 can be used to hold and press the grip portion 61 against the sport equipment 90. It is noted that the first hand covering 70 can correspond to the user's right hand or the user's left hand depending on the user's preference.

Figure 12:
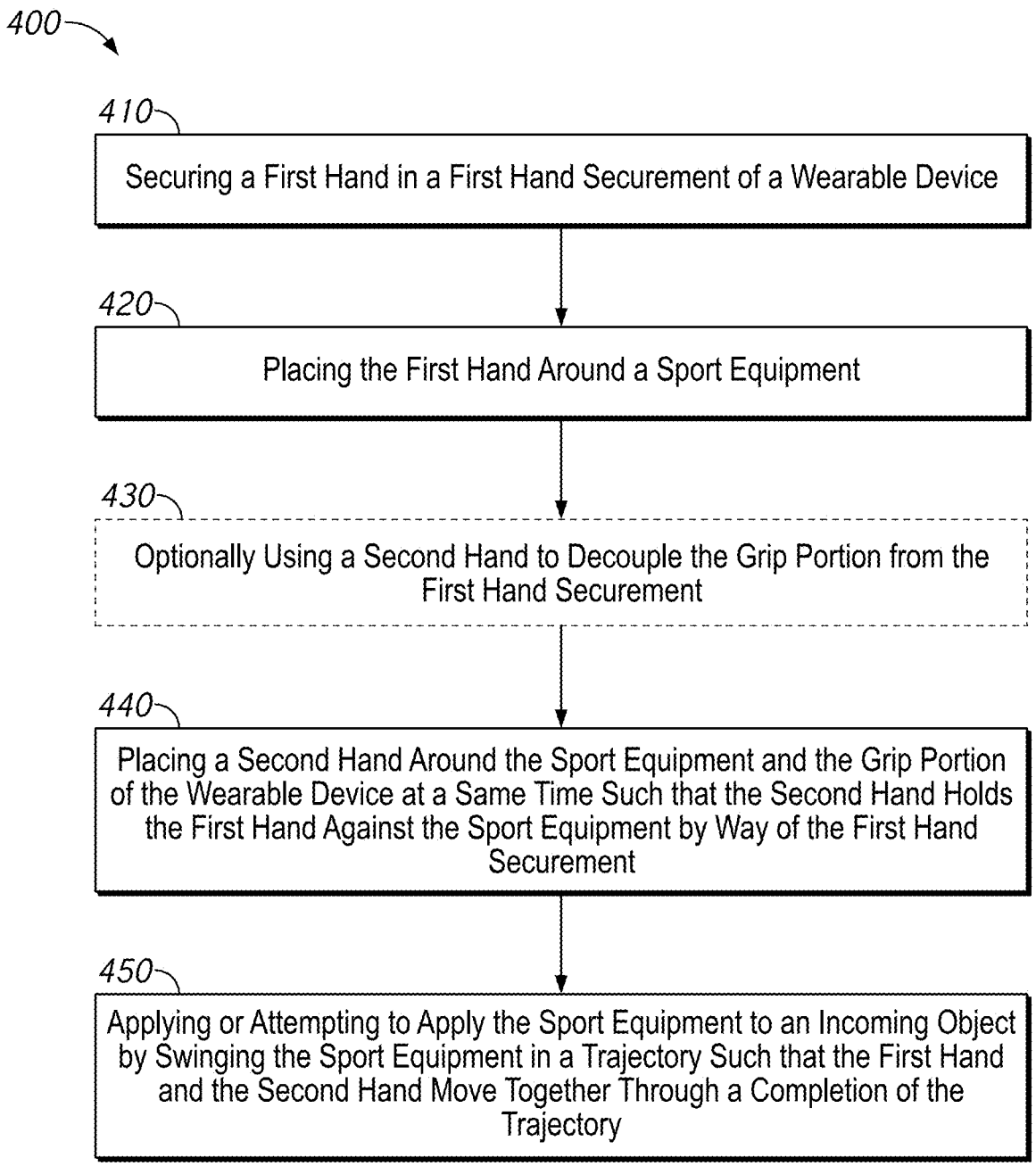
FIG. 12 is a flow diagram of a method of using the device of the present disclosure according to one aspect.

FIG. 12-15 illustrates several aspects of a method of using the device(s) of the present disclosure. FIG. 12 illustrates method 400 of utilizing the device of the present disclosure according to one aspect. At step 410, the method can include securing a first hand in a first hand securement of a wearable device. At step 420, the method can include placing the first hand around a sport equipment. At step 430, the method can include an optional step of using a second hand to decouple the grip portion from the first hand securement. At step 440, the method can include placing a second hand around the sport equipment and the grip portion of the wearable device at a same time such that the second hand holds the first hand against the sport equipment by way of the first hand securement. At step 450, the method can include applying or attempting to apply the sport equipment to an incoming object by swinging the sport equipment in a trajectory such that the first hand and the second hand move together through a completion of the trajectory.

Figure 13:
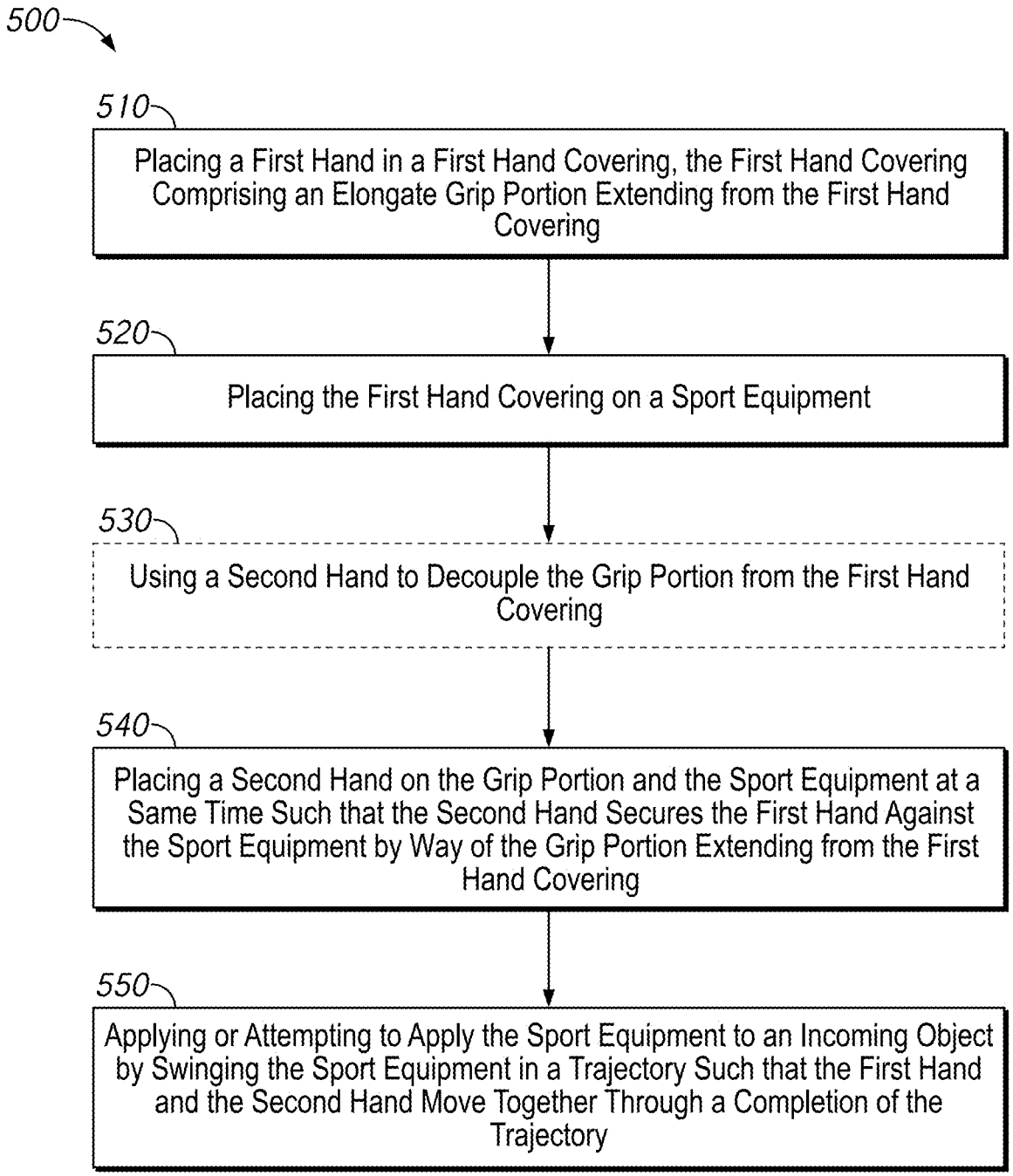
FIG. 13 is a flow diagram of a method of using the device of the present disclosure according to another aspect.

FIG. 13 illustrates method 500 of utilizing the device of the present disclosure according to another aspect. The method 500 can include a step 510 of placing a first hand in a first hand covering. The first hand covering can include an elongate grip portion extending from the first hand covering. The grip portion can be releasably connected to the first hand covering. At step 520, the method can include placing the first hand covering on a sport equipment. The method 500 can include an optional step 530 of using a second hand to decouple the grip portion from the first hand covering. At step 540, the method 500 can include placing a second hand on the grip portion of the first hand covering and the sport equipment at a same time such that the second hand holds the first hand against the sport equipment by way of the grip portion of the first hand covering. At step 550, the method 500 can include applying or attempting to apply the sport equipment to an incoming object by swinging the sport equipment in a trajectory such that the first hand and the second hand move together through a completion of the trajectory.

Figure 14:
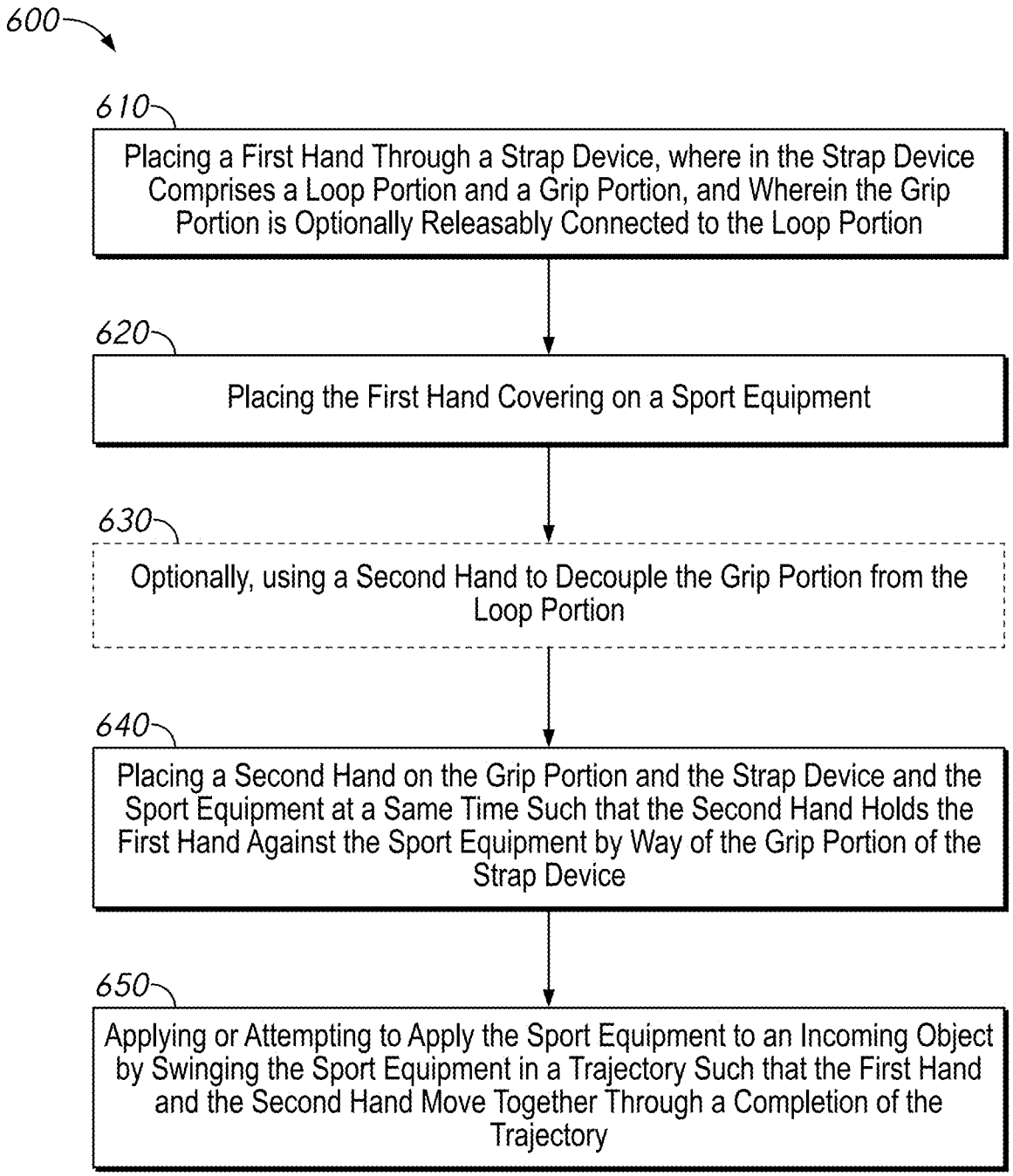
FIG. 14 is a flow diagram of a method of using the device of the present disclosure according to another aspect.

FIG. 14 illustrates method 600 of utilizing the device of the present disclosure according to another aspect. The method 600 can include a step 610 of placing a first hand through a strap device. The strap device can include a loop portion and an elongate grip portion extending form the loop portion. The grip portion can be releasably connected to the loop portion. At step 620, the method 600 can include placing the first hand on a sport equipment. The method 600 can include an optional step 630 of using a second hand to decouple the grip portion from the loop portion. At step 640, the method 600 can include placing a second hand on the grip portion of the strap device and the sport equipment at a same time such that the second hand holds the first hand against the sport equipment by way of the grip portion of the strap device. At step 650, the method 600 can include applying or attempting to apply the sport equipment to an incoming object by swinging the sport equipment in a trajectory such that the first hand and the second hand move together through a completion of the trajectory.

Figure 15:
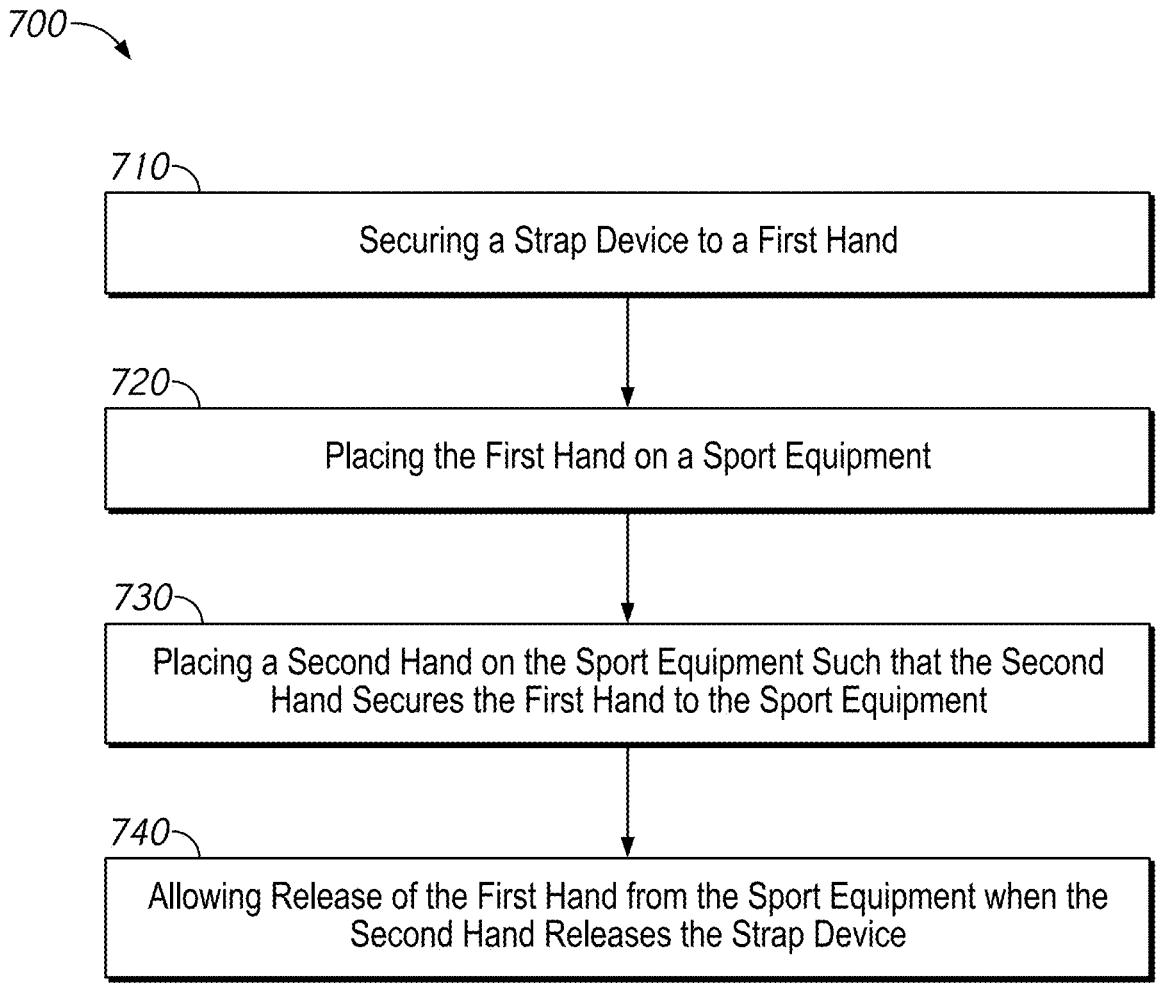
FIG. 15 is a flow diagram of a method of using the device of the present disclosure according to another aspect.

FIG. 15 illustrates method 700 of utilizing the device of the present disclosure according to another aspect. The method 700 can include a step 710 of securing a strap device to a first hand. At step 720, the method 700 can include placing the first hand on a sport equipment. At step 730, the method can include placing a second hand on the sport equipment and the strap device such that the second hand secures the first hand to the sport equipment. At step 740, the method can include allowing release of the first hand from the sport equipment when the second hand releases the strap device.

Operation

As discussed earlier, the strap device 50 can be used to aid a user in maintaining a follow-through motion during a sporting activity, such as when the user attempts to or hits a ball with a baseball bat. The user can wear the first hand covering 70 and the second hand covering 80 prior to utilizing the strap device 50. The user can then enter the first hand covering 70 through the loop portion 60 of the strap device 50 such that four fingers of the user enter through the loop portion 60. In this arrangement, the grip portion 61 is hanging down and away from the loop portion 60. The user can wrap their fingers (and the second hand covering 80 that covers said fingers) around a sport equipment 90 to hold the sport equipment 90 in a desired position. At the same time, the second hand covering 80 can grab and maintain the grip portion 61 of the strap device 50. The user can utilize the second hand to hold and press the grip portion 61 to retain the strap device 50 throughout a swing (or an attempt to swing) motion.

As discussed earlier, the device(s) disclosed in the present disclosure, such as strap device 250 can be utilized without a loop portion. In aspects where the strap device 250 does not include a loop portion (see aspects of the present disclosure illustrated in FIGS. 9A and 9B), the grip portion 261 can be an integral part of the first hand covering 270. The user can wear the first hand covering 270 and the second hand covering 280 prior to utilizing the strap device and decouple the grip portion 261 from the first hand covering 270. The user can wrap their fingers (and the second hand covering 280 that covers said fingers) around a sport equipment 90 to hold the sport equipment 90 in a desired position. At the same time, the second hand covering 280 can grab and maintain the grip portion 261 of the strap device 250. The user can utilize a second hand to hold and press the grip portion 261 to retain the strap device 250 throughout a swing (or an attempt to swing) motion.

In some aspects, such as when the user utilizes the strap device 50 in a baseball game or during a practice or in a training session, the user may have a desire to have both hands on the sport equipment throughout the motion from prior to attempting to hit a ball (or actually hitting a ball) until after the swing is completed. As a result, as long as the user has a desire to grab onto the sport equipment 90, the user can, through the second hand covering 80, continue to hold on to (and squeeze) the grip portion 61 and the sport equipment 90 at the same time. This allows both hands to swing together and enables the user to have a controlled follow-through motion. If the user desires to drop the sport equipment or decouple the movement of the first hand covering 70 from the second hand covering 80 (or decouple the movement of the first hand and the second hand if no hand covering device is being used), the user can simply release the pressure from the grip portion 61.

Although certain aspects and features of the present disclosure are described herein with respect placing one hand (or both hands) in a hand covering device (such as a glove), the scope of the present disclosure is not limited to the use of the present disclosure with a hand covering device (such as a glove). For example, a user does not need to wear a glove to use the present disclosure and can benefit from the present disclosure with a bare hand. Additionally, the use of the present disclosure is not limited to either a left hand or a right hand. Consequently, the devices(s) disclosed in the present disclosure can be used with the left hand and/or the right hand.

It should be emphasized that many variations and modifications may be made to the herein-described aspects, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific aspects disclosed herein may be combined in different ways to form additional aspects, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain aspects include, while other aspects do not include, certain features, elements and/or states. Thus, such conditional language is not generally intended to imply that features, elements and/or states are in any way required for one or more aspects or that one or more aspects necessarily include logic for deciding, with or without author input or prompting, whether these features, elements and/or states are included or are to be performed in any particular aspect.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A method of holding a sport equipment with two hands using a wearable device that allows a user to quickly decouple one or both hands to release the sport equipment during a sporting game, the method comprising:

securing a first hand in a first hand securement of the wearable device, the wearable device having an elongate grip portion extending from the first hand securement, wherein the elongate grip portion comprises:

a first end coupled to the first hand securement, the first end having a connecting edge;

a second end opposite the first end, wherein the second end is a free end;

placing the first hand around a sport equipment;

placing a second hand around the sport equipment and the elongate grip portion of the wearable device between the first end and the second end of the elongate grip portion at a same time such that the second hand restrains movement of the first hand relative to the second hand using only a grip of the second hand around the sport equipment;

contacting or attempting to contact an object by swinging the sport equipment such that the first hand and the second hand move together through a completion of the swing, and the user can freely remove the second hand from both the sport equipment and the elongate grip portion while the first hand is still secured to the wearable device by releasing the grip of the second hand around the sport equipment and the elongate grip portion.

2. The method of claim 1, wherein the wearable device further comprises a hook and loop system such that one of a hook or a loop of the hook and loop system on the elongate grip portion is coupled with the other one of a hook or a loop of the hook and loop system on the first hand securement prior to placing the second hand around the grip portion.

3. The method of claim 2, further comprising a step of using the second hand to decouple the elongate grip portion from the first hand securement.

4. The method of claim 1, wherein the first hand securement comprises a loop portion configured to receive the first hand.

5. The method of claim 1, wherein the first hand securement comprises a glove body.

6. The method of claim 5, wherein the elongate grip portion is integral with the glove body such that the elongate grip portion and the glove body form a single component.

7. The method of claim 1, wherein the elongate grip portion is sewn to the first hand securement.

8. The method of claim 1, wherein the sport equipment is a baseball bat.

9. The method of claim 1, wherein the sport equipment is selected from the group consisting of tennis racket, cricket bat, badminton racket, pickleball paddle, golf club, lacrosse stick, field hockey stick, ice hockey stick, and softball bat.

10. The method of claim 1 wherein the first hand comprises a first hand covering, and the second hand comprises a second hand covering.

* * * * *